US010502520B2

(12) United States Patent
Spurlock

(10) Patent No.: US 10,502,520 B2
(45) **Date of Patent: *Dec. 10, 2019**

(54) PAINTBALL DRIVE SYSTEM OF A PAINTBALL LOADER

(71) Applicant: G.I Sportz, Inc., St. Laurent (CA)

(72) Inventor: Michael S. Spurlock, Tainan (TW)

(73) Assignee: G.I. Sportz, Inc.

( * ) Notice: Subject to any disclaimer, the term of this patent is extended or adjusted under 35 U.S.C. 154(b) by 10 days.

This patent is subject to a terminal disclaimer.

(21) Appl. No.: 15/811,985

(22) Filed: Nov. 14, 2017

(65) Prior Publication Data

US 2018/0073832 A1 Mar. 15, 2018

Related U.S. Application Data

(63) Continuation of application No. 15/046,816, filed on Feb. 18, 2016, now Pat. No. 9,857,141, which is a continuation of application No. 14/285,816, filed on May 23, 2014, now Pat. No. 9,297,605.

(51) Int. Cl.
*F41B 11/53* (2013.01)
*F41B 11/71* (2013.01)

(52) U.S. Cl.
CPC ..... *F41B 11/53* (2013.01); *F41B 11/71* (2013.01)

(58) Field of Classification Search
CPC ..... F41B 11/53; F41B 11/71
See application file for complete search history.

(56) References Cited

U.S. PATENT DOCUMENTS

| | | | | |
|---|---|---|---|---|
| 5,816,232 | A * | 10/1998 | Bell | F41B 11/53 124/51.1 |
| 6,915,792 | B1 * | 7/2005 | Sheng | F41B 11/54 124/48 |
| 7,854,220 | B1 * | 12/2010 | Neumaster | F41B 11/53 124/51.1 |
| 8,047,190 | B2 * | 11/2011 | Kaakkola | F41B 11/53 124/1 |
| 2003/0047173 | A1 * | 3/2003 | Juan | F41B 11/53 124/49 |
| 2006/0086347 | A1 * | 4/2006 | Hedberg | F41B 11/53 124/51.1 |

(Continued)

*Primary Examiner* — Jeffrey S Vanderveen
(74) *Attorney, Agent, or Firm* — Craig R. Rogers; Simple IP Law, P.C.

(57) ABSTRACT

A loader and drive system are provided. The loader is preferably configured to house a quantity of projectiles (such as paintballs) in a chamber and supply the quantity of projectiles from the chamber to an attached pneumatic gun when in operation. The loader preferably includes an outlet configured to supply projectiles from the chamber to the pneumatic gun when the loader is operatively connected to the pneumatic gun. A drive system may be arranged in the loader and include a non-rotating center member arranged above the outlet with an entrance. A way may be arranged to direct projectiles into the outlet from the chamber through the entrance. An arm may be provided and attached to the center member to direct projectiles into the entrance. A driving member may surround the non-rotating center member and rotate around the non-rotating member. The driving member preferably urges projectiles from the chamber into the way and toward the outlet during operation of the loader.

20 Claims, 7 Drawing Sheets

(56) References Cited

U.S. PATENT DOCUMENTS

| | | | | |
|---|---|---|---|---|
| 2009/0178659 | A1* | 7/2009 | Spicer | F41B 11/57 124/51.1 |
| 2010/0126485 | A1* | 5/2010 | Neumaster | F41B 11/57 124/51.1 |

* cited by examiner

PAINTBALL DRIVE SYSTEM OF A PAINTBALL LOADER

PRIORITY CLAIM

This application is a continuation of, and claims priority from, U.S. patent application Ser. No. 15/046,816, filed Feb. 18, 2016, now U.S. Pat. No. 9,857,141, issued Jan. 2, 2018, which is a continuation of U.S. patent application Ser. No. 14/285,816, filed May 23, 2014, now U.S. Pat. No. 9,297,605, issued Mar. 29, 2016, the contents of each of which are incorporated herein by reference in their entirety.

BACKGROUND OF THE INVENTION

Field of the Invention

The present invention relates to a paintball drive system, and more particularly, to a paintball drive system of a paintball loader.

Descriptions of Related Art

Paintball guns typically use a paintball loader to feed paintballs into the gun so as to permit them to shoot continuously. The paintballs are ejected from the paintball gun using pressurized air which is provided by a high-pressure bottle. Generally, the paintball loader is attached on the top of the paintball gun and the paintballs are fed into the paintball gun one by one by a drive system in the paintball loader. In conventional loaders, the drive system comprises a disk with an inclined ramp and at least one plate located on the ramp. The disk is driven by a motor and the paintballs are shifted by the plate toward a passage, and the paintballs travel through the passage and enter into the gun one by one. Paintballs generally have a flexible and thin shell that is filled with paint. Unfortunately, paintballs may not travel through the loader as expected and/or the paintball shell may be broken during movement of the paintballs. Paintballs becoming jammed within the loader is a major problem for the players.

The present inventive concepts provide a paintball loader, and a paintball drive system of a paintball loader, that eliminate the shortcomings of the conventional art.

SUMMARY OF THE INVENTION

The present inventive concepts relate to a paintball loader and a paintball drive system of a paintball loader. The paintball drive system may be located in a paintball loader which has a top casing and a bottom casing. The paintball drive system may comprise a board having a hole, and an inclined ramp that extends from the periphery of the hole. A power unit may be connected to one end of the board. A base may be located at the underside of the board and located corresponding to the hole. A room or chamber may be formed in the top of the base and a non-rotating center member, such as a cone, a cover, or both, may be arranged on the base over an outlet. The outlet may be defined through a center of the center member and a paintball way may be formed along the base and communicate with the room. The member may provide an entrance which communicates with the outlet and the paintball way. A gear ring may be located in the room of the base and have teeth defined in the outside thereof. The power unit may be engaged with the teeth to rotate the gear ring. A driving member may, for instance, include a friction ring and/or a driving ring. The friction ring may be located at the inside of the gear ring so as to push the paintballs toward the entrance. The driving ring may be connected to the gear ring and rotated by the gear ring so as to move the paintballs.

Preferably, the board has two wings respectively extending from two sides thereof, and each of the two wings has an engaging edge which is connected to the top and bottom casings.

Preferably, the friction ring is made of multiple duraometer silicone and has multiple protrusions extending at equal distance from the inner periphery thereof so as to move the paintballs.

Preferably, the power unit has a power source and at least one transmission member. The power source has an output shaft which rotates the at least one transmission member which is engaged with the teeth of the gear ring so as to rotate the gear ring which in turn drives the driving member.

Preferably, a first sensor is located beneath the inclined ramp and detects the presence or absence of paintballs in the paintball loader.

Preferably, the power unit has a first gear and a second gear whose teeth are less than those of the first gear. The output shaft of the power source is engaged with the first gear which is engaged with the second gear. The second gear is engaged with the teeth of the gear ring.

Preferably, a second sensor is located at the outlet of the base and detects paintballs passing through the outlet.

Preferably, the first and second sensors are electrically connected to each other.

Preferably, a non-touch sensor is connected to a root portion of the paintball loader. The non-touch sensor activates or shuts off electric power by way of non-physical touch.

Preferably, the first and second sensors are infrared sensors.

The primary object of the present inventive concepts is to provide a paintball loader and a paintball drive system of a paintball loader, wherein paintballs (or other projectiles) are smoothly fed into the paintball (or pneumatic) gun and are not broken during feeding. In other words, the loader and drive system of the present inventive concepts preferably eliminate jamming and breaking of paintballs within the loader and drive system.

The present inventive concepts will become more readily apparent from the following description when taken in connection with the accompanying drawings which show, for purposes of illustration only, a preferred embodiment.

DETAILED DESCRIPTION OF THE PREFERRED EMBODIMENT

Figure 1:
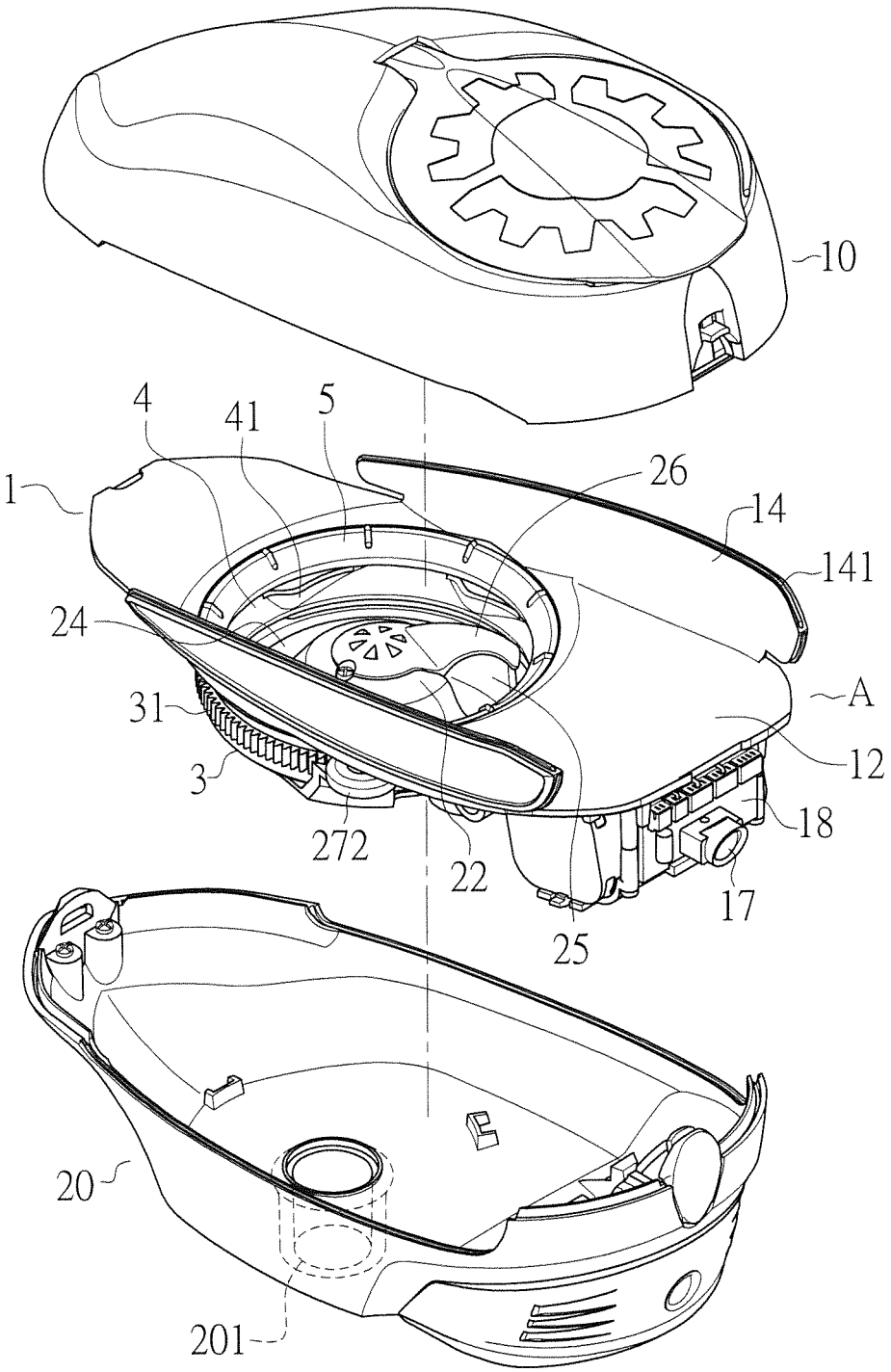
FIG. 1 is an exploded view of a paintball loader and drive system according to the present inventive concepts.
Figure 2:
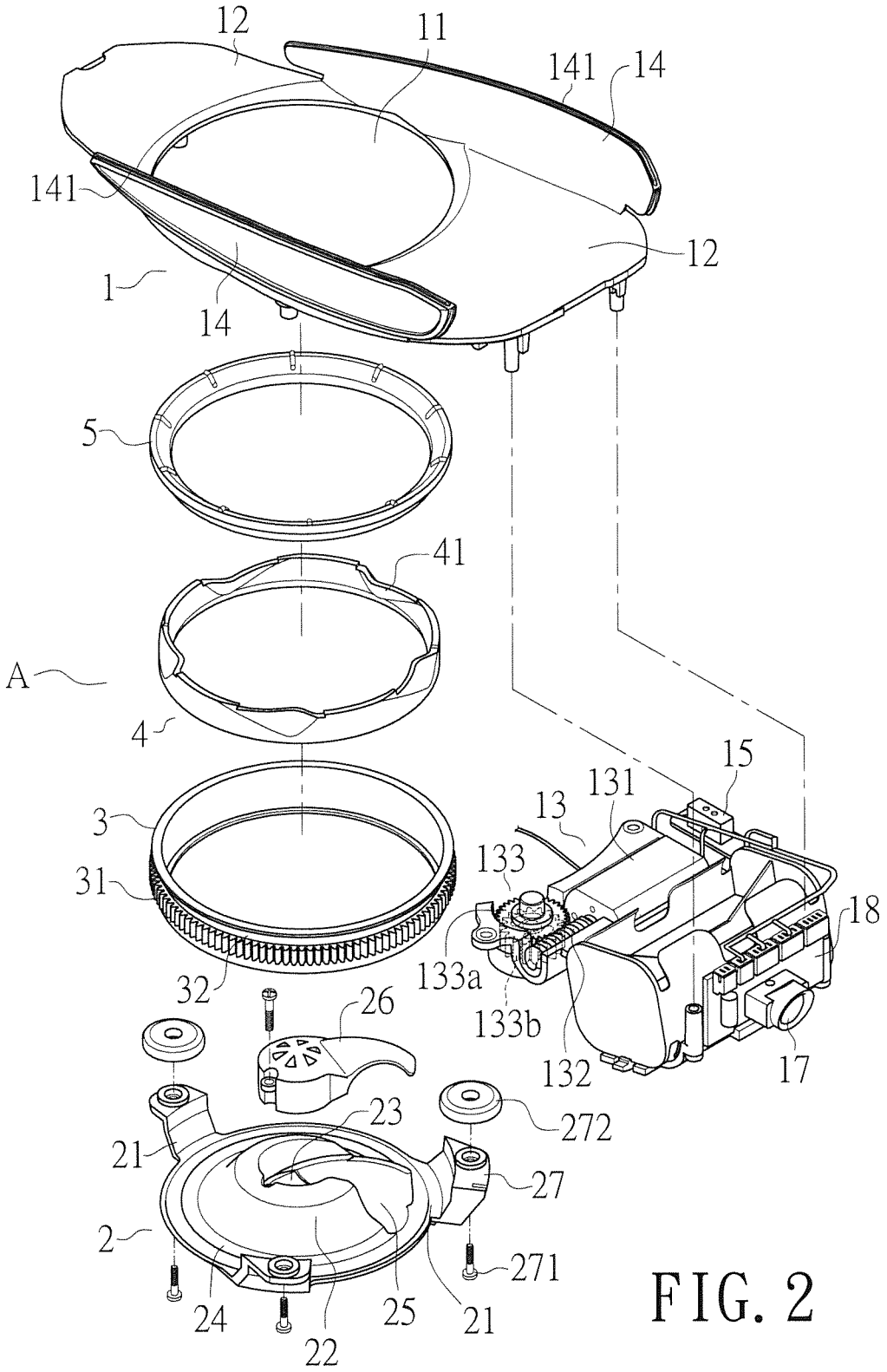
FIG. 2 is an exploded view of the paintball drive system of the paintball loader of FIG. 1.

Referring initially to FIGS. 1 and 2, a paintball loader according to the present inventive concepts may comprise a top casing 10 and a bottom casing 20, and a paintball drive system "A" may be arranged between the top and bottom casings 10, 20, respectively.

The paintball drive system "A" of the present inventive concepts may comprise a board (or floorboard) 1 having a hole 11 which may be defined therethrough, and an inclined ramp 12 extending from the periphery of the hole 11. A power unit 13 may be connected to one end of the board 1.

A base 2 may be arranged at or near the underside of the board 1 and positioned at a location corresponding to the hole 11. A room or chamber 21 may formed in the top of the base 2. A center member (such as a cone 22, cover 26, or both), that is non-rotatable with respect to the base 2 and loader casings 10, 20, extends from the top of the base 2, and an outlet 23 is defined below the center member. A paintball way 24 may be formed along the periphery of the cone 22 and/or a floor of the base 2 to communicate with the room 21. The cone 22 may further include an entrance 25 which communicates with the outlet 23 and the paintball way 24. The cover 26 may be engaged with the outlet 23. Multiple connection members 27 may be provided which extend from the base 2 so as to be connected with the board 1 by locking members 271. Each of the connection members 27 may include a roller 272 connected thereto. These rollers 272 may be located beneath the board 1.

A gear ring 3 may be located in the room 21 of the base 2 and have teeth 31 defined in the outside thereof. The power unit 13 is preferably engaged with the teeth 31 to rotate the gear ring 3. An annular groove 32 may be defined in the outside of the gear ring 3 and located above the teeth 31, and the rollers 272 may move along the annular groove 32.

A friction ring 4 may be located at the inside of the gear ring 3 so as to push paintballs in the chamber 21 toward the entrance 25. Multiple protrusions 41 may be arranged at equal distances from one another and may extend inwardly a small distance from the inner periphery thereof.

A driving ring 5 may be connected to the gear ring 3 and may be rotated by the gear ring 3 arranged in the hole 11 to move the paintballs.

As shown in FIGS. 1 to 7, the board 1 may have two wings 14, each extending from a respective one of the two sides thereof, and each of the two wings 14 may have an engaging edge 141 which is connected to the top casing 10 and the bottom casing 20. The bottom casing 20 may include a path 201 which is in communication with the outlet 23. The top and bottom casings 10, 20, respectively, are preferably easily connected to the engaging edge 141 of the board 1, and preferably do not require any tool to make the connection or to be disconnected from each other.

When in use, the paintballs located in the room or chamber between the board 1 and the top casing 10 enter the hole 11 and are moved toward the paintball way 24. The paintballs in the base 2 contact a non-action surface of the paintball way 24 and are moved by friction force along a guiding face of the friction ring 4 and the driving ring 5. Paintballs loaded into the loader are arranged in the room between the center member, the friction ring 4 and the paintball way 24. The paintballs are detected by the first sensor 15 which is electrically connected with a control circuit 18. The control circuit 18 activates a power source 131 of the power unit 13, and an output shaft 132 of the power source 131 drives at least one transmission member 133 which is engaged with the teeth 31 of the gear ring 3 so that the gear ring 3 is rotated. The motor of the control circuit 18 controls the revolutions per minute (R.P.M.) of the power source. In one preferable embodiment, the power unit 13 has a first gear 133*a* and a second gear 133*b* whose teeth are less than those of the first gear 133*a*. The output shaft 132 of the power source 131 is engaged with the first gear 133*a* which is engaged with the second gear 133*b*, and the second gear 133*b* is engaged with the teeth 31 of the gear ring 3. By this arrangement, a gear reduction unit may be provided and utilized.

When the gear ring 3 rotates, the driving member, which may include the friction ring 4 and the driving ring 5, is rotated. The paintballs are driven by friction force provided by the friction ring 4 and the driving ring 5 so as to roll along the paintball way 24.

When the gear ring 3 rotates clockwise, each of the paintballs rolls along a fixed surface (provided by the paintball way 24), and a movable surface (provided by the friction ring 4 or the driving ring 5). The paintballs are moved by the friction ring 4 toward the cone 22 and reach the cover 26. The cover 26 may include an arm that guides the paintballs to the outlet 23 so that the paintballs enter into the path 201. When the paintballs reach the cover 26 and the entrance 25, because the entrance 25 and the paintball way 24 may be two different faces joined together, the paintballs may be temporarily stopped at the interface between the entrance 25 and the paintball way 24, and then forced into the path 201 by the following paintballs.

Figure 5:
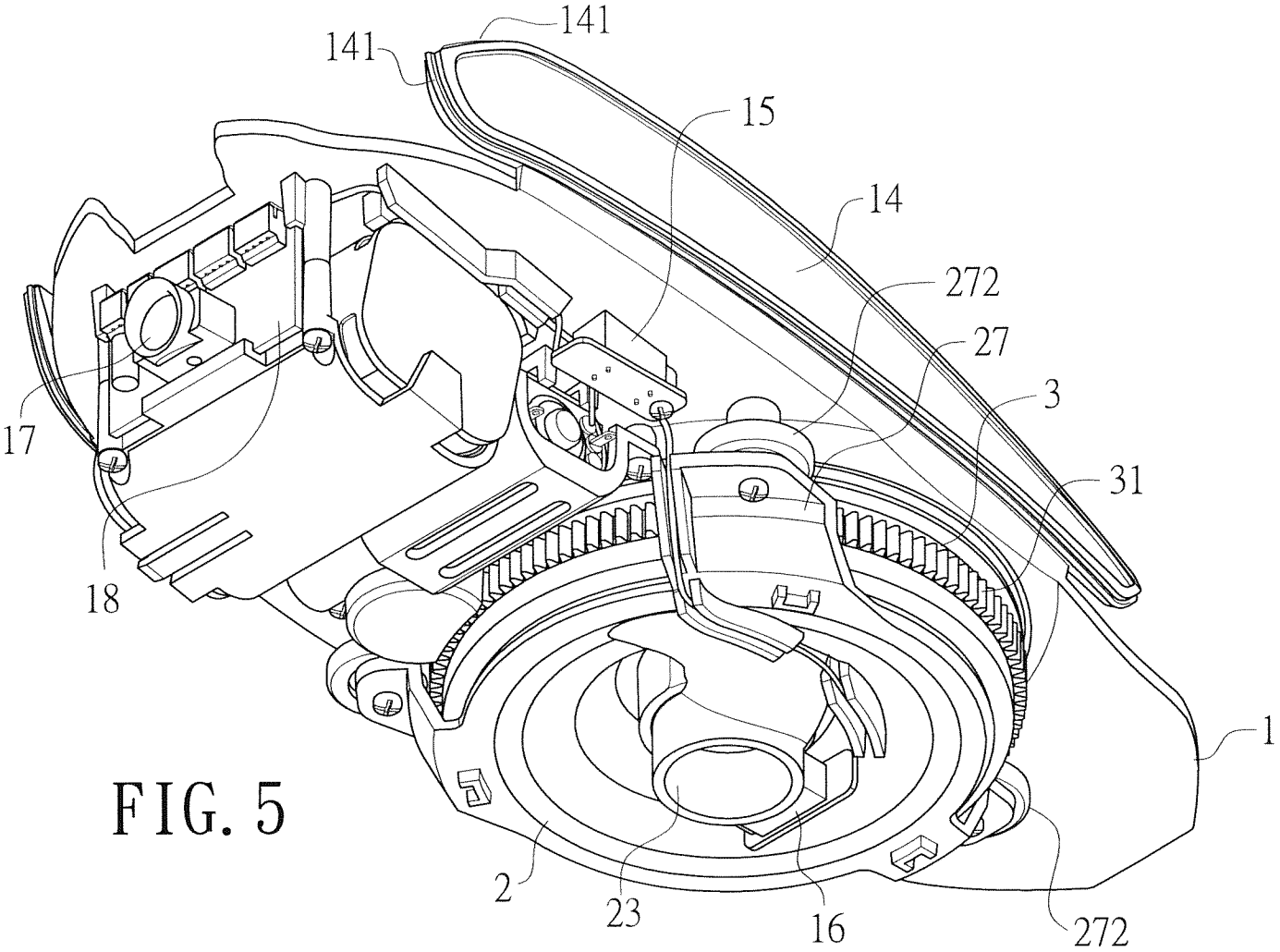
FIG. 5 is a bottom perspective view of the drive system of the paintball loader of FIG. 1.
Figure 6:
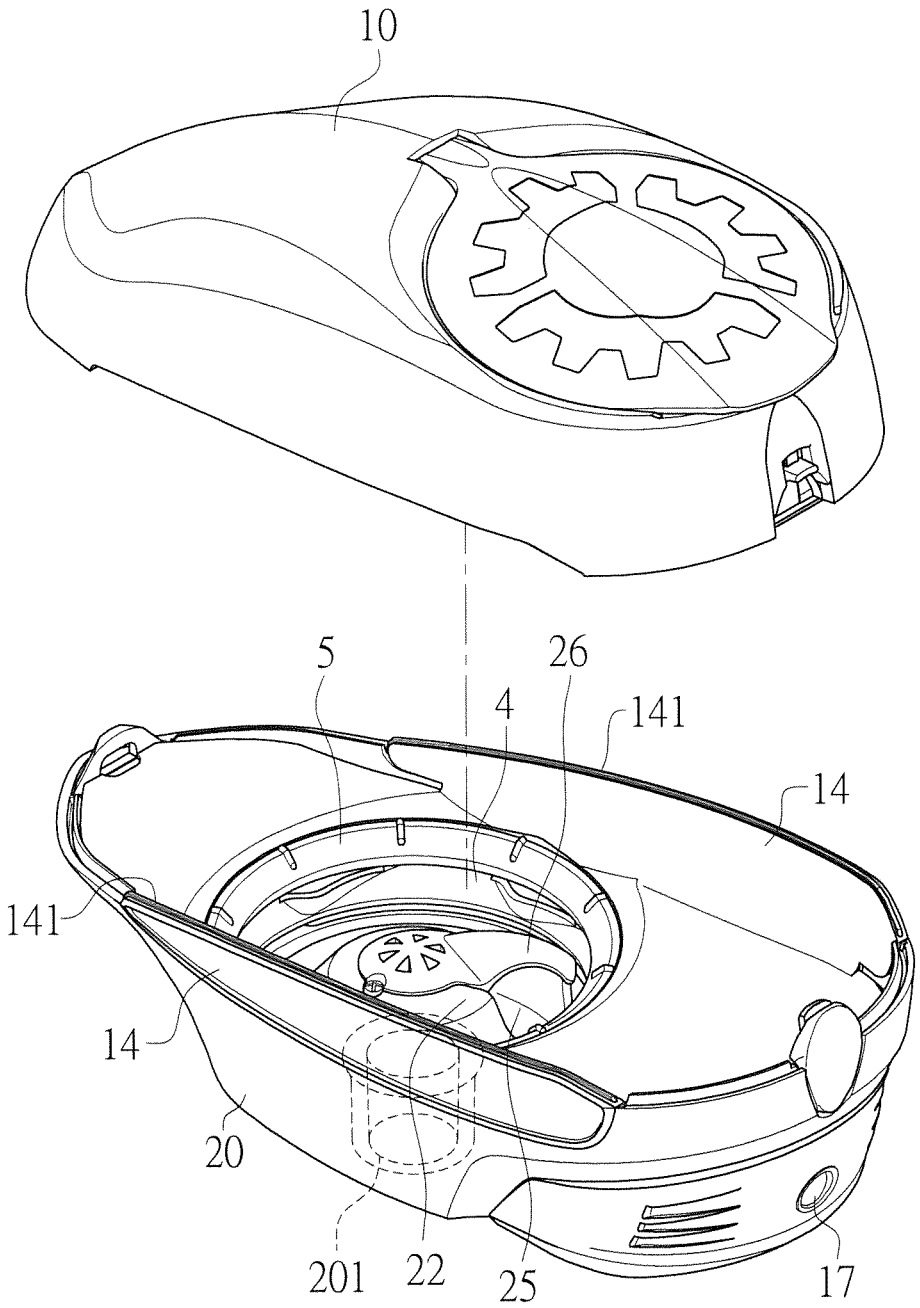
FIG. 6 is a top perspective view showing the top casing and bottom casing of the loader FIG. 1 separated from each other.
Figure 7:
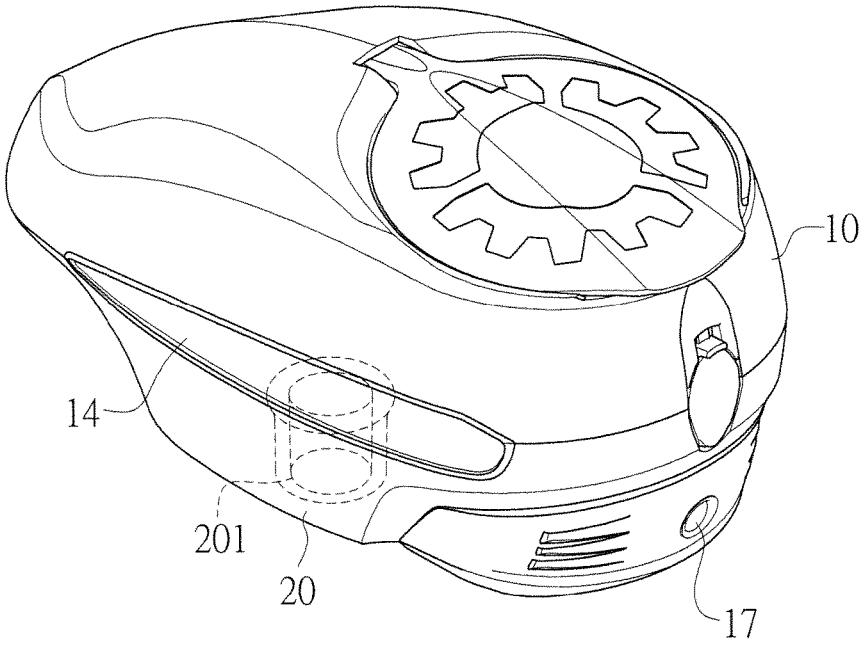
FIG. 7 is a top perspective view showing the fully assembled paintball loader of FIG. 1, according to principles of the present inventive concepts.

Referring now to FIG. 5, paintball guns may fire as fast as 30 to 40 paintballs per second, and the present inventive concepts further provide a device to let the player know the timing for supplying paintballs through the outlet 23 to the paintball gun. More particularly, a first sensor 15 may be located under the ramp 12. The first sensor 15 can be an infrared sensor. A second sensor 16 may be located at the outlet 23 of the base 2 so as to detect paintballs passing through the outlet 23. The second sensor 16 may also be an infrared sensor. The first and second sensors 15, 16 are preferably electrically connected to the control circuit 18. By detecting the paintballs in the chamber and passing through the outlet, the power source can be activated or shut off at appropriate times to move paintballs through the loader to the paintball gun.

Figure 3:
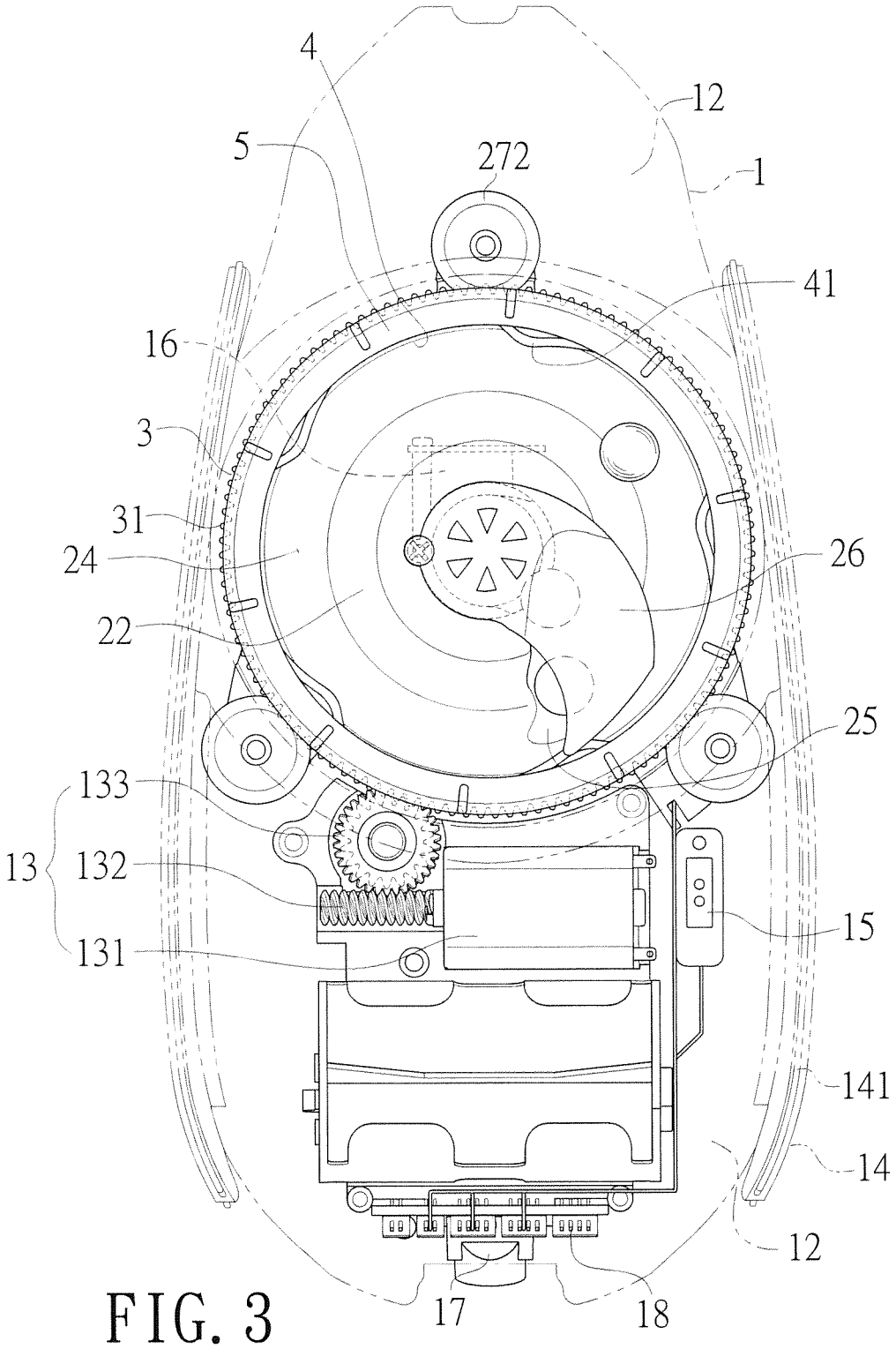
FIG. 3 is a transparent top view of the paintball loader of FIG. 1 provided to illustrate the relative positions of the parts of the paintball drive system of the paintball loader.
Figure 4:
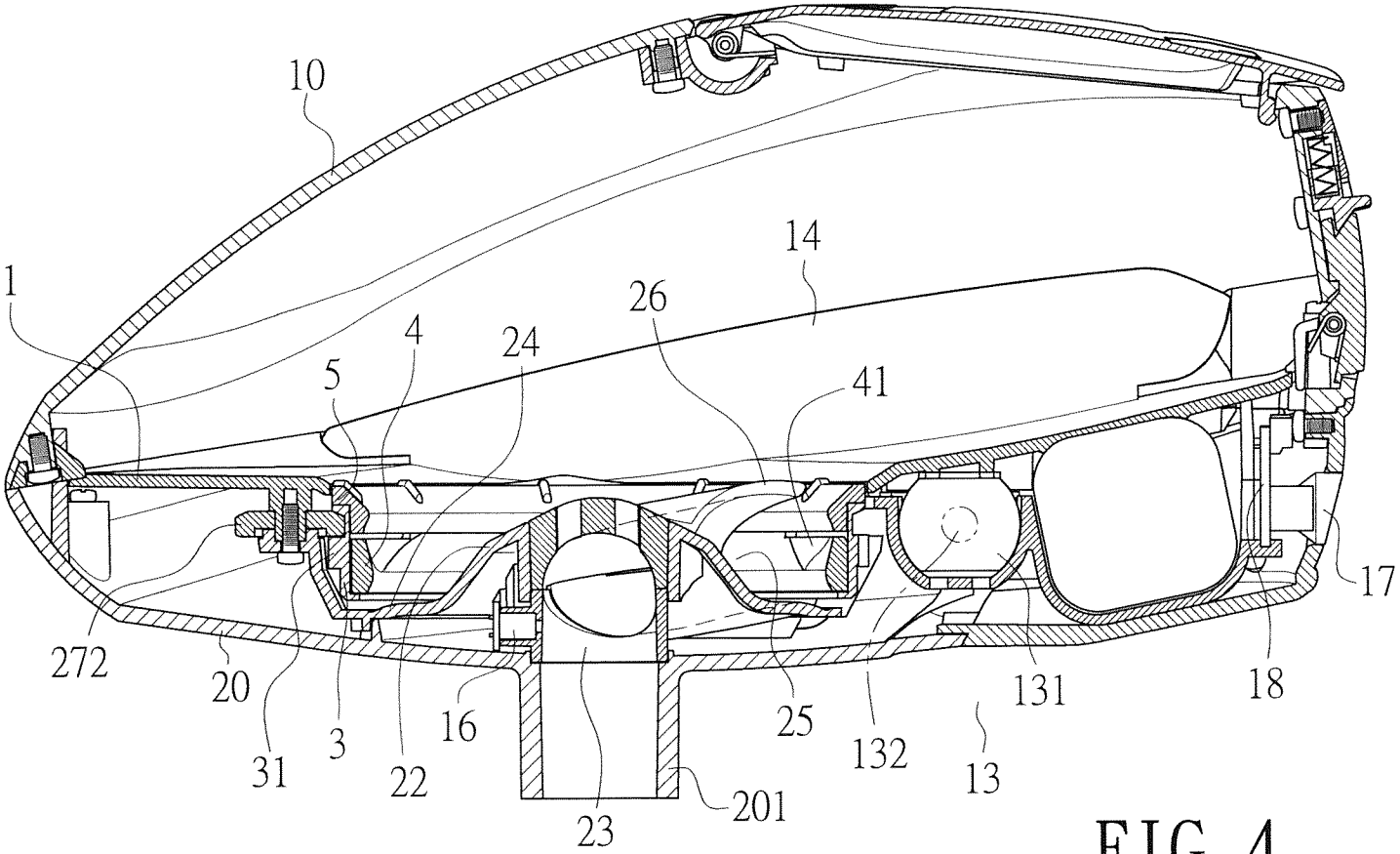
FIG. 4 is a side cross-sectional view of the paintball loader of FIG. 1.

Referring to FIGS. 3 to 5, when the second sensor 16 determines that no paintballs are in the outlet or that the paintballs are not moving, a signal from the first sensor 15 is also checked to determine the absence or presence of paintballs in the chamber. If paintballs are not moving through the outlet and no paintballs are present in the chamber, the power source 131 is shut off via the control circuit 18 and the paintball loader thereby stops the driving operation. When paintballs are loaded into the paintball loader, the first sensor 15 detects the paintballs and the power source 131 is activated via the control circuit 18. Accordingly, paintballs in the paintball loader enter into the entrance 25 via the paintball way 24 until the second sensor 16 detects the paintballs moving through the outlet 23.

Using the combination of signals from the first and second sensors 15, 16, the player may be informed of the status of the paintball loader. Furthermore, when a jam is detected (for instance when paintballs are detected in the chamber by the first sensor 15 and the second sensor 16 detects no paintball movement through the outlet 23), a signal is sent by the control circuit 18 to rotate the power source in reverse to clear the jam. Once the jam is cleared, the drive system operates to drive paintballs forward through the paintball way and the paintballs are again fed normally.

In addition to the components described above, a non-touch sensor 17 may be provided and connected to a main portion of the paintball loader. The non-touch sensor 17 may comprise a non-physical-touch sensor that does not need to be physically touched by an object to activate or shut off the electric power. The "ON" and "OFF" operation of the paintball loader may thereby be controlled by simply inserting a finger into an area where a power icon is marked, and movement of the finger can activate or shut off the power via the non-touch sensor 17.

The friction ring 4 can be made of multiple duraometer silicone to provide a surface that imparts a frictional force on the paintballs to roll them along the paintball way 24 of the base 2. By providing a frictional force to urge the paintballs along, rather than arms that catch and force paintball movement, the risk of breaking paintballs within the loader can be significantly reduced.

Using these principles, the paintballs can be smoothly and quickly urged and guided along the paintball way 24 of the base 2 toward the outlet 23 so that the paintball gun can shoot continuously without jamming.

According to still other principles of the inventive concepts, the connection between the first and second casings 10, 20 and the wings can be easily connected and disconnected quickly without the use of any tool.

According to still other principles, the player can be informed of an operational status of the loader (including if the chamber is empty) via LED indicators arranged on the paintball loader. The operational status can be determined using the combination of signals from the first and second sensors 15, 16. Based on information obtained from the sensors and indicated by the LEDs, the player can reload more efficiently.

The non-physical-touch sensor arranged on the surface of a main body of the paintball loader can also enable the player to activate or shut off the power quickly and easily while also ensuring that it is not inadvertently deactivated by accidental bumping or jarring.

While we have shown and described a preferred embodiment in accordance with the present inventive concepts, it should be clear to those skilled in the art that further embodiments may be made without departing from the scope of those concepts.

What is claimed is:

1. A loader configured to house a quantity of projectiles in a chamber and supply projectiles from the chamber to an attached pneumatic gun when in operation, said loader comprising:

an outlet configured to supply projectiles from the chamber to the pneumatic gun when the loader is operatively connected to the pneumatic gun;

a non-rotating member covering the outlet, said outlet having an entrance; and a driving member comprising a ring, said ring comprising protrusions, each protrusion having a base that is wider than a tip thereof, said protrusions extending radially inwardly toward the outlet from base to tip, said ring configured to rotate around the non-rotating member, wherein rotation of the ring around the non-rotating member urges projectiles from the chamber toward the entrance during operation of the loader.

2. The loader according to claim 1, further comprising a way and an arm arranged on the non-rotating member, each configured to direct projectiles into the entrance from the chamber.

3. The loader according to claim 1, wherein the non-rotating member and driving member are arranged together with a board having upwardly extending wings configured to be connected to a loader casing.

4. The loader according to claim 1, wherein the protrusions comprise small bumps extending inwardly from a friction ring of the driving member a radial distance from base to tip that is less than half the radial distance from the base to the outlet.

5. The loader according to claim 1, wherein the driving member comprises a friction ring that is separate from, and non-integral with, a driving ring configured to rotate the friction ring.

6. The loader according to claim 5, further comprising a gear ring that is separate from the friction ring and the driving ring, and is configured to connect with the friction ring and the driving ring to form a single, unified ring.

7. The loader according to claim 1, wherein an outlet sensor is located proximal to the outlet and is adapted to detect projectiles passing through the outlet.

8. The loader according to claim 7, further comprising a chamber sensor adapted to detect projectiles in the chamber, and wherein the outlet and chamber sensors are electrically connected to each other, and wherein a drive system is configured to use information received from both sensors to determine whether to activate or shut off a power source of the driving member.

9. The loader according to claim 1, further comprising a non-touch sensor located on the loader and configured to activate or shut off electric power to a power source of a motor for the driving member in response to user actuation of the sensor by way of finger or hand movement in proximity to the non-touch sensor.

10. The loader according to claim 8, wherein the sensors are infrared sensors.

11. A paintball drive system comprising:

an outlet configured to supply paintballs through the outlet;

a non-rotating member covering the outlet and providing an entrance to the outlet;

a driving member surrounding but not covering the outlet and configured to rotate around the outlet, wherein said driving member is configured to urge paintballs toward the outlet during operation of the drive system using protrusions that extend from base to tip radially inwardly toward the outlet.

12. The paintball drive system of claim 11, wherein the driving member comprises a friction ring surrounding and configured to rotate around the outlet, said friction ring comprising the protrusions, each protrusion extending radially inward a radial distance that is less than half of a radial distance between the base of the protrusion and the outlet, wherein said protrusions are configured to urge paintballs toward the outlet during operation of the drive system.

13. The paintball drive system of claim 11, further comprising a chamber sensor configured to detect the presence or absence of paintballs in a paintball chamber, and an outlet sensor configured to detect the presence or absence of paintballs in the outlet.

14. The paintball drive system of claim 13, wherein the paintball drive system is configured to use information received from both sensors to determine whether to actuate the drive system to drive rotation of the driving member.

15. The paintball drive system of claim 14, wherein the drive system is configured to be actuated only when paintballs are detected in the chamber by the chamber sensor but no paintballs are detected in the outlet by the outlet sensor.

16. A paintball loader for use with a paintball gun, said paintball loader configured to supply a quantity of paintballs to the paintball gun through an outlet thereof when operatively connected to the paintball gun, said paintball loader comprising:

a housing comprising a chamber for containing a quantity of paintballs and an outlet for supplying paintballs from the paintball loader to a connected paintball gun;

a drive system configured to receive paintballs from the chamber and drive paintballs from the chamber toward the outlet, said drive system comprising:

a non-rotating center member covering the outlet, wherein the non-rotating center member is stationary with respect to the housing;

a driving member comprising a ring that surrounds but does not cover the outlet and is configured to rotate around the outlet to drive paintballs toward an entrance to the outlet using a plurality of protrusions arranged along the ring and connected to each other only by the ring; and a power unit configured to drive the driving member.

17. The paintball loader according to claim 16, said ring comprising a friction ring surrounding the outlet, said friction ring comprising the protrusions, said protrusions extending towards, the outlet a radial distance that is less than half of a radial distance between an outer periphery of the ring and the outlet, wherein said protrusions are configured to urge paintballs toward the outlet when the friction ring is rotated.

18. The paintball loader according to claim 16, wherein the non-rotating center member further comprises a paintball way providing a channel for directing paintballs into the outlet.

19. The paintball loader according to claim 18, wherein the non-rotating center member further comprises an arm for directing paintballs into the paintball way.

20. The paintball loader according to claim 16, further comprising a first sensor and a second sensor, wherein the paintball loader is configured to actuate the power unit only when paintballs are detected in the chamber by the first sensor but no paintballs are detected in the outlet by the second sensor.

* * * * *